US010056694B2

(12) United States Patent
Doyle et al.

(10) Patent No.: US 10,056,694 B2
(45) Date of Patent: Aug. 21, 2018

(54) BROADBAND BLADE ANTENNA DEFINING A KITE-SHAPED OUTER PROFILE

(71) Applicant: The Boeing Company, Chicago, IL (US)

(72) Inventors: Joseph A. Doyle, Hazelwood, MO (US); James M. Bornholdt, Pacific, MO (US); Alexander T. Bradshaw, St. Peters, MO (US)

(73) Assignee: The Boeing Company, Chicago, IL (US)

( * ) Notice: Subject to any disclaimer, the term of this patent is extended or adjusted under 35 U.S.C. 154(b) by 335 days.

(21) Appl. No.: 14/845,970

(22) Filed: Sep. 4, 2015

(65) Prior Publication Data

US 2017/0069971 A1 Mar. 9, 2017

(51) Int. Cl.

| | |
|---|---|
| ***H01Q 1/50*** | (2006.01) |
| ***H01Q 9/40*** | (2006.01) |
| ***H01Q 1/28*** | (2006.01) |
| ***H01Q 5/335*** | (2015.01) |

(52) U.S. Cl.

CPC ..... *H01Q 9/40* (2013.01); *H01Q 1/283* (2013.01); *H01Q 5/335* (2015.01)

(58) Field of Classification Search

CPC ..... H01Q 1/243; H01Q 1/38; H01Q 9/285; H01Q 9/28; H01Q 9/42

USPC ..... 343/860, 700 MS, 795, 824

See application file for complete search history.

(56) References Cited

U.S. PATENT DOCUMENTS

| | | | | |
|---|---|---|---|---|
| 2,568,710 | A | 9/1951 | Bolljahn | |
| 2003/0076269 | A1 | 4/2003 | Kuramoto | |
| 2005/0110687 | A1* | 5/2005 | Starkie | H01Q 5/00 343/700 MS |
| 2011/0148722 | A1* | 6/2011 | Bellows | H01Q 9/30 343/729 |

OTHER PUBLICATIONS

EP, Extended European Search Report and Opinion; European Patent Application No. 16187220.5, 11 pages (dated Feb. 3, 2017).

Ammann, M.J. et al; "Small Planar Monopole Covers Multiband Brans"; 30th European Microwave Conference Proceedings; Conf. 30, XP-001060920, pp. 242-245 (Oct. 4, 2000).

Manac'h, L. et al.; "Performance of a Lozenge Monopole Antenna Made of Pure Composite Laminate"; Progress in Electomagnetics Research Letters, vol. 35, XP055126259, pp. 115-123 (Jan. 1, 2012).

Ammann, M.J.; "Control of the Impedance Bandwidth of Wideband Planar Monopole Antennas Using a Beveling Technique"; Microwave and Optical Technology Letters; vol. 30, No. 4; pp. 229-232 (Aug. 4, 2001).

(Continued)

*Primary Examiner* — Dameon E Levi
*Assistant Examiner* — Collin Dawkins
(74) *Attorney, Agent, or Firm* — Vivacqua Law

(57) ABSTRACT

A broadband blade monopole antenna is disclosed. The broadband blade monopole antenna includes a body portion that is substantially flat to define a two-dimensional plane that the body portion extends along. The body portion defines an outer perimeter having four sides. The four sides are grouped into two pairs of equal-length sides positioned directly adjacent to each other. The broadband blade monopole antenna provides at least about 100% impedance bandwidth.

20 Claims, 2 Drawing Sheets

(56) References Cited

OTHER PUBLICATIONS

Sairam, Chandana et al.; "Broadband Blade Antenna for Airborne Applications"; Defence Electronic Research Laboratory; Hyderabad, India; pp. 1-4 (Dec. 16-18, 2011).
Ahirwar, S.D. et al.; "Broadband Blade Monopole Antenna Covering 100-2000 MHz Frequency Band"; Defence Electronics Research Laboratory; Chandrayangutta lines, Hyderabad-05; pp. 1-4 (Dec. 14-16, 2009).
Jusoh, M. et al.; "A Compact Dual Bevel Planar Monopole Antenna with Lumped Element for Ultra High Frequency/Very High Frequency Application"; Microwave and Optical Technology Letters; vol. 54, No. 1; pp. 156-160 (Jan. 1, 2012).

* cited by examiner

BROADBAND BLADE ANTENNA DEFINING A KITE-SHAPED OUTER PROFILE

FIELD

The disclosed system relates to an antenna and, more particularly, to a broadband blade monopole antenna that is substantially flat and defines a kite-shaped outer perimeter.

BACKGROUND

Antennas are generally used to transform electrical power into a radiated wave, and vice-versa. There are numerous types of antennas that are currently available that may be selected based on the specific application. For example, a broadband antenna may be distinguished by its relatively wide bandwidth, thereby making the broadband antenna highly desirable for certain types of applications. In general, a broadband antenna provides at least about 100% impedance bandwidth, and operates over a frequency greater than about twenty-five percent of its center operating frequency.

Although broadband antennas have numerous advantages, it may be challenging to produce a low-cost broadband antenna that has specific performance characteristics required for a particular application. Some examples of antenna performance characteristics include, but are not limited to, impedance bandwidth, electrical size, voltage standing wave ratio (VSWR) at a specific frequency, gain patterns, aerodynamic qualities, and packaging constraints. In particular, it may be especially challenging to produce a broadband antenna that has a relatively high impedance bandwidth that is electrically small in size, and that is also relatively inexpensive to manufacture. Thus, there exists a continuing need in the art for a cost-effective broadband antenna that is relatively simple and inexpensive to produce.

SUMMARY

The disclosed antenna is a broadband blade monopole antenna that includes a relatively simple design, and is also inexpensive to manufacture. Indeed, the antenna may be manufactured using relatively low-cost manufacturing processes such as, but not limited to, metal stamping. Moreover, the antenna does not typically require machining or any other labor-intensive manufacturing processes. Finally, it should be appreciated that the overall kite-shaped outer profile as seen in the figures may enhance efficiency and the overall aerodynamic shape of the antenna.

In one aspect, a broadband blade monopole antenna is disclosed. The broadband blade monopole antenna includes a body portion that is substantially flat to define a two-dimensional plane that the body portion extends along. The body portion defines an outer perimeter having four sides. The four sides are grouped into two pairs of equal-length sides positioned directly adjacent to each other. The broadband blade monopole antenna provides at least about 100% impedance bandwidth.

In another aspect, a broadband blade monopole antenna is disclosed. The broadband blade monopole antenna includes a body portion that is a solid piece and has a height to width ratio of 9.2 to 8.4. The body portion is substantially flat to define a two-dimensional plane that the body portion extends along. The body portion defines a kite-shaped outer perimeter having four sides. The four sides are grouped into two pairs of equal-length sides positioned directly adjacent to each other. The broadband blade monopole antenna provides at least about 100% impedance bandwidth.

Other objects and advantages of the disclosed method and system will be apparent from the following description, the accompanying drawings and the appended claims.

DETAILED DESCRIPTION

Figure 1:
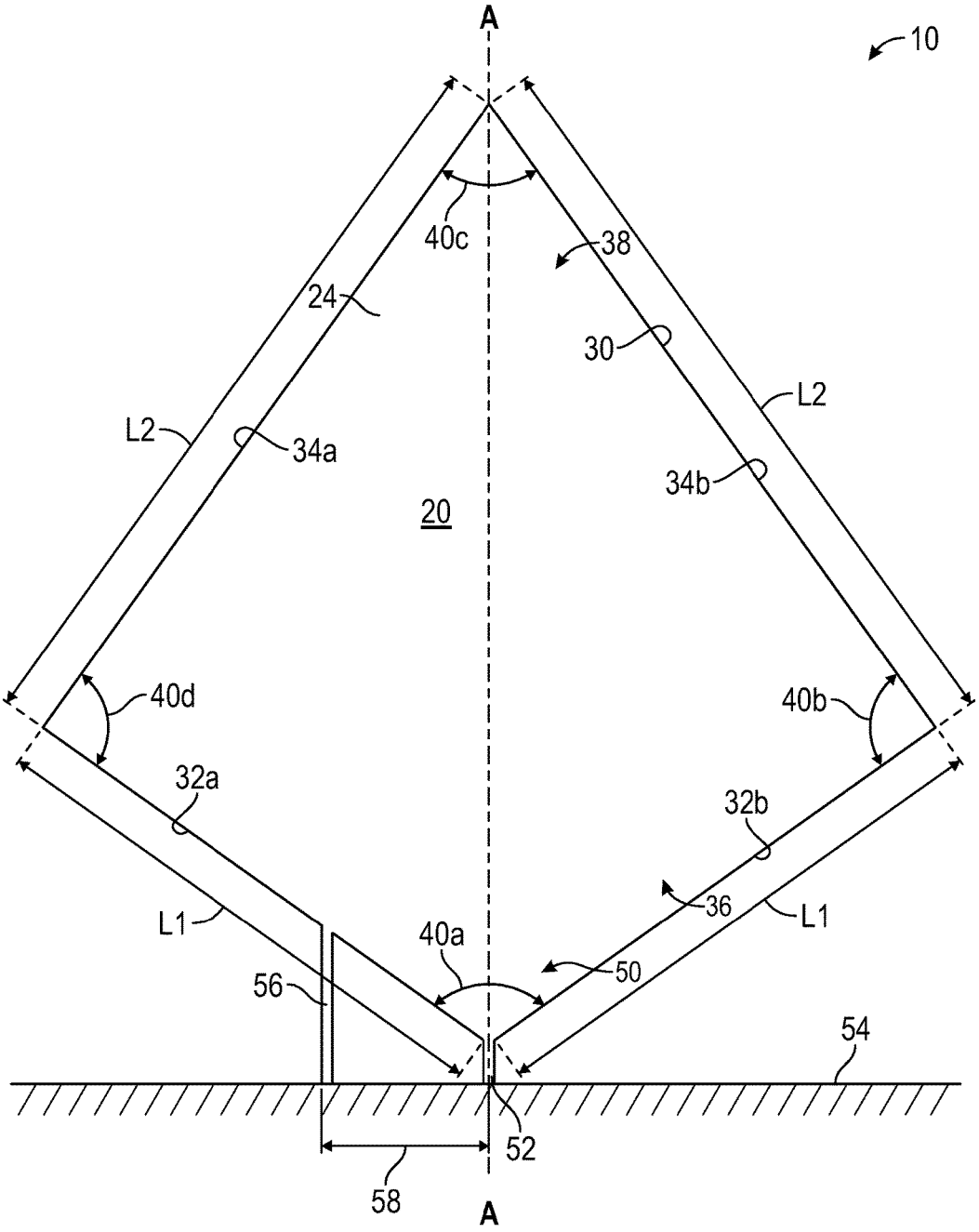
FIG. 1 is a front view of the disclosed antenna connected to a feed point and a ground plane.
Figure 2:
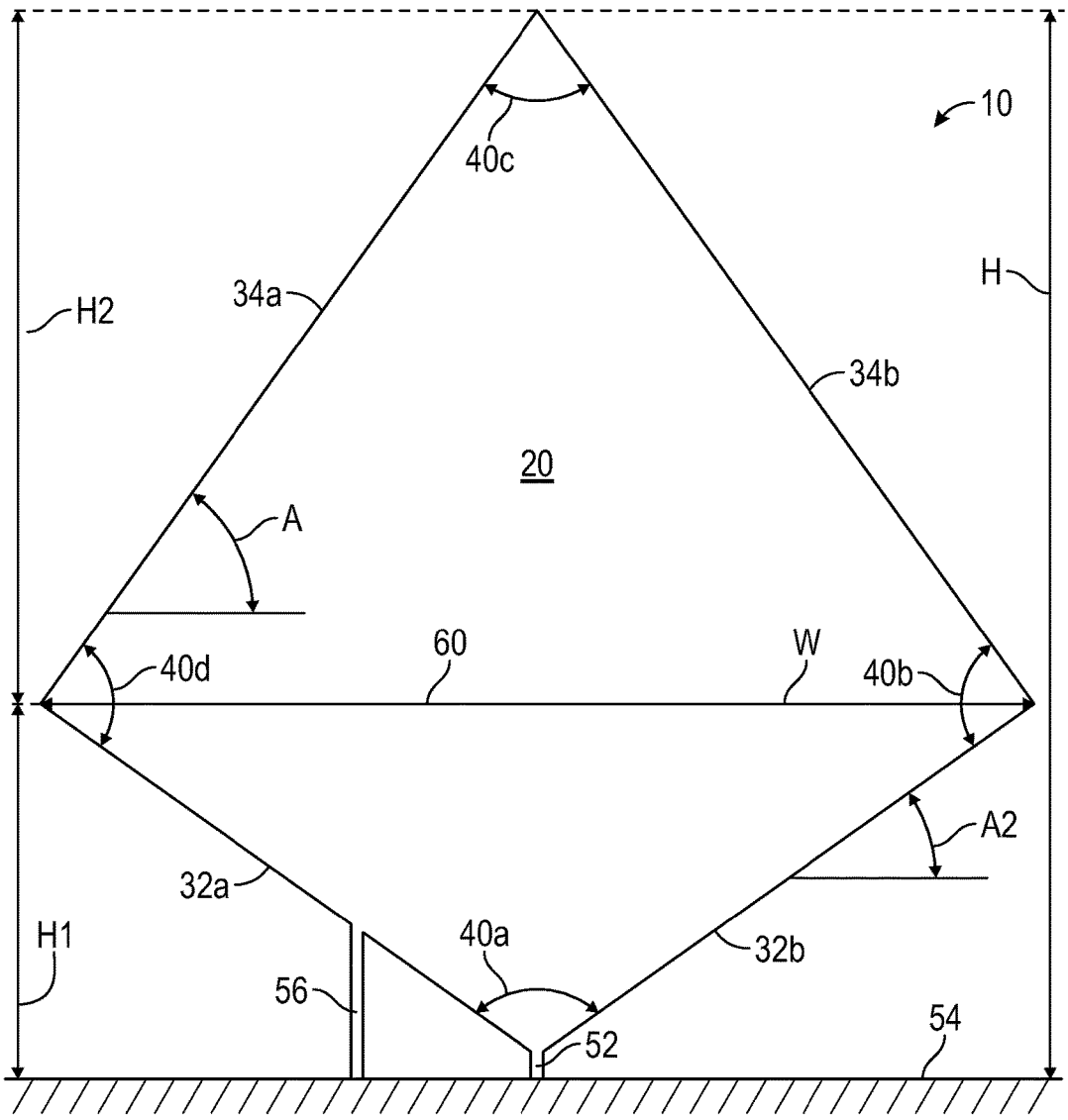
FIG. 2 is an illustration of one exemplary embodiment of the antenna shown in FIG. 1, where the antenna includes a height to width ratio of 9.2 to 8.4.

FIG. 1 is an illustration of the disclosed antenna 10. In the embodiments as disclosed, the antenna 10 may be a broadband blade monopole antenna. That is, the antenna 10 provides at least about 100% impedance bandwidth, and operates over a frequency greater than about twenty-five percent of its center operating frequency. In one exemplary embodiment, which is described in greater detail below and illustrated in FIG. 2, the antenna 10 may provide about 184.6% impedance bandwidth. However, it is to be understood that the disclosed antenna 10 is not limited to the specific embodiment as shown in FIG. 2. The antenna 10 may be used in very high frequency (VHF) as well as ultra high frequency (UHF) applications.

Referring back to FIG. 1, the antenna 10 may define a body portion 20. The body portion 20 of the antenna 10 may be substantially flat, thereby defining a relatively flat two-dimensional plane that the body portion 20 extends along. Specifically, in one embodiment, the antenna 10 may be substantially flat so that there is no more than 0.5 inches (1.27 centimeters) of distortion along the two-dimensional plane that the body portion 20 defines. In one embodiment, the body portion 20 of the antenna 10 may be constructed of a metal material such as, for example, aluminium or any other conductive material. In another embodiment, the antenna 10 may be constructed of a printed circuit material. It is to be appreciated that the antenna 10 may be created using a relatively simple, low-cost manufacturing process, thereby lowering the overall cost of the antenna 10. For example, in one approach, the antenna 10 may be a stamped metal part that requires minimal or no machining, or any other labor-intensive manufacturing processes.

In the non-limiting embodiment as shown in FIG. 1, the body portion 20 of the antenna 10 is a solid piece. That is, there are no holes, slots, cavities, indentations, or other types of irregularities along an outer surface 24 of the antenna 10. It is to be appreciated that features such as holes, slots, or other irregularities along the outer surface 24 of the body portion 20 may add cost and complexity to the antenna 10. However, it should also be appreciated that the antenna 10 is not limited to just a solid body. Indeed, in another embodiment, the antenna 10 may include irregularities such as holes, or slots. However, it should be appreciated that such features may increase the overall cost to manufacture the antenna 10.

In the embodiment as shown, the antenna 10 defines an outer perimeter 30. The outer perimeter 30 of the antenna 10 defines four sides, which are side 32*a*, side 32*b*, side 34*a*, and side 34*b*. As seen in FIG. 1, the sides 32*a*, 32*b* are located along a lower portion 36 of the antenna 10. The sides 32*a*, 32*b* each define a length L1. The sides 32*a*, 32*b* are equal to one another in length. The sides 34*a*, 34*b* are located along an upper portion 38 of the antenna 10. The sides 34*a*, 34*b* each define a length L2. The sides 34*a*, 34*b* are equal to one another in length.

As seen in FIG. 1, the length L1 of sides 32*a*, 32*b* is less than the length L2 of sides 34*a*, 34*b* of the antenna 10. Furthermore, the outer perimeter 30 of the antenna 10 defines a generally kite-shaped outer profile. Specifically, the kite-shaped outer perimeter 30 of the antenna 10 defines a quadrilateral including four sides 32*a*, 32*b*, 34*a*, 34*b* as well as four vertices or corners 40*a*, 40*b*, 40*c*, 40*d*. It should also be appreciated that the four sides 32*a*, 32*b*, 34*a*, 34*b* of the outer perimeter 30 of the antenna 10 may be grouped into two pairs of equal-length sides that are positioned directly adjacent to each other. Specifically, the sides 32*a*, 32*b* of the antenna 10, which are equal to one another in length, are positioned directly adjacent to one another. Furthermore, the sides 34*a*, 34*b* of the antenna 10, which are also equal to one another in length, are also positioned directly adjacent to one another. Also, the body portion 20 is symmetrical about its longitudinal axis A-A.

In one non-limiting embodiment, the corner 40*a*, which is located at a lowermost portion 50 of the antenna 10, may be electrically connected to a feed 52. The feed 52 may be connected to a ground plane 54. The ground plane 54 may be a conductive surface such as, for example, the skin of an aircraft. It is to be appreciated that the overall kite-shaped outer perimeter 30 of the antenna 10 defines an aerodynamic profile. The aerodynamic profile of the antenna 10 may result in reduced drag when compared to other profiles that are currently used for antennas, which is especially beneficial in aircraft applications. Furthermore, the antenna 10 may be omni-directional antenna with respect to azimuth. That is, the antenna 10 may include a generally uniform gain as the antenna rotates in azimuth. The antenna 10 may cover multiple contiguous frequency bands, and is relatively electrically small in size. For example, in the embodiment as shown in FIG. 2, the antenna 10 may include an electrical height of about 0.015 wavelengths at its lowest operating frequency.

Turning back to FIG. 1, in one non-limiting embodiment, the antenna 10 may be electrically connected to a matching circuit 56. Specifically, the matching circuit 56 may be electrically connected to the side 32*a* of the antenna 10 as well as the ground plane 54. However, in another embodiment, the matching circuit 56 may be electrically connected to one of the other sides 32*b*, 34*a*, or 34*b* of the antenna 10 instead. The matching circuit 56 may include at least one passive linear element. Some examples of passive linear elements include resistors, capacitors, and inductors. It should also be appreciated that the matching circuit 56 may include any combination of one or more passive linear elements. In one non-limiting embodiment which is described below and is shown in FIG. 2, the matching circuit 56 may include a 150 ohm resistor.

It should be appreciated that the matching circuit 56 is optional, and may or may not be included with the antenna 10. However, the matching circuit 56 may widen the bandwidth of the antenna 10. It should also be appreciated that the position of the matching circuit 56 relative to the feed 52 may also be adjusted based on the specific dimensions and requirements of the antenna 10. Specifically, the matching circuit 56 may be positioned at a distance 58 from the feed 52. It is to be appreciated that the matching circuit 56 may be moved towards the feed 52 or away from the feed 52 depending on the requirements of the antenna 10. In the exemplary embodiment as shown in FIG. 2, the matching circuit 56 is positioned about half an inch (about 1.27 centimeters) from the feed 52.

The sides 32*a*, 32*b* located along the lower portion 36 of the antenna 10 define a bevel with respect to the ground plane 54. That is, the sides 32*a*, 32*b* located along the lower portion 36 of the antenna 10 are not oriented at a right angle that is perpendicular with respect to the ground plane 54. Instead, the sides 32*a*, 32*b* define a sloping edge with respect to the ground plane 54. The sides 34*a*, 34*b* located along the upper portion 38 of the antenna 10 may be slanted or angled as well.

FIG. 2 is an exemplary embodiment of the antenna 10, where the antenna 10 has an overall height H of about 9.2 inches (23.3 centimeters) and an overall width W of about 8.4 inches (21.3 centimeters). The height H is measured from the ground plane 54 to the top most corner 40*c* of the antenna 10. The width W is measured from the leftmost corner 40*b* to the rightmost corner 40*b*. It is to be understood that in one embodiment, the antenna 10 may include any size having a height to width ratio of 9.2 to 8.4. For example, in another embodiment, the antenna 10 may have a height of about 18.4 inches (46.7 centimeters) and a width of about 16.8 inches (42.6 centimeters), but still includes a height to width ratio of 9.2 to 8.4. In the non-limiting embodiment shown in FIG. 2, the matching circuit 56 includes a 150 ohm resistor. Furthermore, the matching circuit 56 is positioned about half an inch (1.27 centimeters) away from the feed 52.

As seen in FIG. 2, if a substantially horizontal line 60 is drawn through the corners 40*b* and 40*d* of the antenna 10, then the height H of the antenna 10 is divided into two sections, a first height H1 and a second height H2. The first height H1 is measured from the ground plane 54 to the horizontal line 60, and the second height H2 is measured from the horizontal line 60 to the top most corner 40*c* of the antenna 10. The ratio of the first height H1 and the second height H2 is 3.2 to 6. Furthermore, an angle A may be measured between the horizontal line 60 and one of the upper sides 34*a*, 34*b*. In the embodiment as shown in FIG. 2, the angle A is about 55°. A second angle A2 may also be measured between one of the bottom sides 32*a*, 32*b* and the ground plane 54. In the embodiment as shown in FIG. 2, the second angle A2 is about 35.7°.

In the embodiment as shown in FIG. 2, the antenna 10 has a voltage standing wave ratio (VSWR) of less than 3:1 at frequencies ranging from about 20 to about 500 Megahertz (MHz). The antenna 10 may also include an electrical height of about 0.015 wavelengths at its lowest operating frequency. Moreover, the antenna 10 having the dimensions as shown in FIG. 2 (i.e., the height H is about 9.2 inches and the width W is about 8.4 inches) provides about 184.6% impedance bandwidth.

Referring generally to the figures, the disclosed antenna 10 is a broadband blade monopole antenna that includes a relatively simple design, and is also inexpensive to manufacture. Indeed, the antenna 10 may be manufactured using relatively low-cost manufacturing processes such as, but not limited to, metal stamping. Moreover, the antenna 10 does not typically require machining or any other labor-intensive manufacturing processes. Finally, it should be appreciated that the overall kite-shaped outer profile as seen in the figures may enhance efficiency and the overall aerodynamic shape of the antenna 10.

While the forms of apparatus and methods herein described constitute preferred aspects of this disclosure, it is to be understood that the disclosure is not limited to these precise forms of apparatus and methods, and that changes may be made therein without departing from the scope of the disclosure.

What is claimed is:

1. A broadband blade monopole antenna, comprising:

a body portion that is substantially flat to define a two-dimensional plane that the body portion extends along, the body portion defining an outer perimeter having four straight sides, wherein the four straight sides are grouped into two pairs of equal-length sides, wherein the two pairs of equal-length sides are positioned directly adjacent to each other, and wherein the broadband blade monopole antenna provides at least 100% fractional bandwidth for an impedance bandwidth and center frequency of the antenna.

2. The broadband blade monopole antenna of claim 1, wherein the body portion defines four corners and the outer perimeter of the body portion is kite-shaped.

3. The broadband blade monopole antenna of claim 2, wherein a corner located at a lowermost portion of the antenna is electrically connected to a feed point.

4. The broadband blade monopole antenna of claim 3, wherein the feed point is connected to a ground plane.

5. The broadband blade monopole antenna of claim 1, wherein the body portion is symmetrical about a longitudinal axis of the antenna.

6. The broadband blade monopole antenna of claim 1, wherein the body portion of the antenna defines a height to width ratio of 9.2 to 8.4.

7. The broadband blade monopole antenna of claim 6, wherein the antenna includes an electrical height of about 0.015 wavelengths at a lowest operating frequency.

8. The broadband blade monopole antenna of claim 6, wherein the antenna has a voltage standing wave ratio (VSWR) of less than 3:1 at frequencies ranging from about 20 to about 500 Megahertz (MHz) and about 184.6% impedance bandwidth.

9. The broadband blade monopole antenna of claim 6, comprising a matching circuit that is electrically connected to one of the four sides of the antenna, wherein the matching circuit includes a 150 ohm resistor.

10. The broadband blade monopole antenna of claim 1, comprising a matching circuit that is electrically connected to one of the four sides of the antenna.

11. The broadband blade monopole antenna of claim 10, wherein the matching circuit is electrically connected to a ground plane.

12. The broadband blade monopole antenna of claim 10, wherein the matching circuit includes at least one passive linear element.

13. The broadband blade monopole antenna of claim 1, wherein the body portion of the antenna is a solid piece.

14. A broadband blade monopole antenna, comprising:

a body portion that is a solid piece and has a height to width ratio of 9.2 to 8.4, the body portion being substantially flat to define a two-dimensional plane that the body portion extends along, the body portion defining a kite-shaped outer perimeter having four straight sides, wherein the four straight sides are grouped into two pairs of equal-length sides, wherein the two pairs of equal-length sides are positioned directly adjacent to each other, and wherein the broadband blade monopole antenna provides at least 100% fractional bandwidth for an impedance bandwidth and center frequency of the antenna.

15. The broadband blade monopole antenna of claim 14, wherein the body portion defines four corners.

16. The broadband blade monopole antenna of claim 15, wherein a corner located at a lowermost portion of the antenna is electrically connected to a feed point.

17. The broadband blade monopole antenna of claim 14, wherein the antenna includes an electrical height of about 0.015 wavelengths at a lowest operating frequency.

18. The broadband blade monopole antenna of claim 14, wherein the body portion is symmetrical about a longitudinal axis of the antenna.

19. The broadband blade monopole antenna of claim 14, wherein the antenna has a voltage standing wave ratio (VSWR) of less than 3:1 at frequencies ranging from about 20 to about 500 Megahertz (MHz) and about 184.6% impedance bandwidth.

20. The broadband blade monopole antenna of claim 14, comprising a matching circuit that is electrically connected to one of the four sides of the antenna, wherein the matching circuit includes a 150 ohm resistor.

* * * * *